US008342090B2

(12) United States Patent
Hermann

(10) Patent No.: US 8,342,090 B2
(45) Date of Patent: Jan. 1, 2013

(54) INK ROLLER FOR A HAND-HELD LABELLING DEVICE

(75) Inventor: Martin Hermann, Hirschhorn (DE)

(73) Assignee: K-D Hermann GmbH Contact-Preisauszeichnung-Etikettiersysteme, Hirschhorn (DE)

( * ) Notice: Subject to any disclaimer, the term of this patent is extended or adjusted under 35 U.S.C. 154(b) by 370 days.

(21) Appl. No.: 12/656,114

(22) Filed: Jan. 19, 2010

(65) Prior Publication Data

US 2010/0326300 A1 Dec. 30, 2010

(30) Foreign Application Priority Data

Jun. 30, 2009 (DE) ..... 10 2009 027 354

(51) Int. Cl.

| | |
|---|---|
| ***B41F 5/00*** | (2006.01) |
| ***B41F 7/00*** | (2006.01) |
| ***B41F 9/00*** | (2006.01) |
| ***B41F 11/00*** | (2006.01) |
| ***B41F 1/46*** | (2006.01) |
| ***B41F 31/14*** | (2006.01) |
| ***B41F 1/08*** | (2006.01) |
| ***B41K 1/22*** | (2006.01) |
| ***B41L 27/16*** | (2006.01) |

(52) U.S. Cl. ..... 101/329; 101/348; 101/295

(58) Field of Classification Search ..... 101/324, 101/325, 326, 329, 335, 348, 295, 292, 288
See application file for complete search history.

(56) References Cited

U.S. PATENT DOCUMENTS

| | | | | |
|---|---|---|---|---|
| 4,119,033 | A | 10/1978 | Sato | |
| 4,301,729 | A | 11/1981 | Fujita | |
| 5,415,094 | A * | 5/1995 | Morrone | 101/327 |
| 5,906,161 | A * | 5/1999 | Kessler | 101/351.7 |
| 6,516,719 | B2 | 2/2003 | Mistyurik | |
| 6,619,204 | B2 * | 9/2003 | Mistyurik | 101/335 |
| 6,766,842 | B1 * | 7/2004 | Mistyurik et al. | 156/384 |

FOREIGN PATENT DOCUMENTS

| | | |
|---|---|---|
| DE | 29 04 256 | 6/1986 |
| JP | 2007238134 | 9/2007 |

* cited by examiner

*Primary Examiner* — Judy Nguyen
*Assistant Examiner* — Leo T Hinze
(74) *Attorney, Agent, or Firm* — Paul Vincent

(57) ABSTRACT

An ink roller (40) for a hand-held labelling device with a jacket-shaped ink receiving roller (42) and an ink roller axis (43), wherein the ink receiving roller (42) is disposed on the ink roller axis (43) in such a fashion that the free ends of the ink roller axis (43) project on both sides past the end faces of the ink receiving roller (42), and a hand-held labelling device having an ink roller (40) of this type. One gripping disk (46) that is spaced apart from the ink receiving roller (42) is thereby provided at each free end of the ink roller axis (43).

6 Claims, 3 Drawing Sheets

INK ROLLER FOR A HAND-HELD LABELLING DEVICE

This application claims Paris Convention priority of DE 10 2009 027 354.9 filed Jun. 30, 2009 the complete disclosure of which is hereby incorporated by reference.

BACKGROUND OF THE INVENTION

The invention concerns an ink roller for a hand-held labelling device, comprising a jacket-shaped ink receiving roller and an ink roller axis, wherein the ink receiving roller is disposed on the ink roller axis in such a fashion that the free ends of the ink roller axis project on both sides past the end faces of the ink receiving roller.

A hand-held labelling device having an ink roller of this type is disclosed in DE 29 04 256 A1. The ink receiving roller is thereby produced e.g. from a foamed material, the pores of which contain the ink for printing adhesive labels with the hand-held labelling device. The ink roller axis is normally produced from a substantially rigid plastic material. The free ends of the ink roller axis, which project past the end faces of the ink receiving roller, are used to rotatably dispose the ink roller in an ink roller holder, which is normally changed together with the ink roller when the ink in the ink receiving roller has been used up.

The hand-held labelling device has a label printing mechanism, which usually enables variable presetting of a sequence of symbols, e.g. a number and/or letter sequence, as a printing pattern. It also includes transport means by means of which the labels that are glued one after the other on a label carrier tape can be further transported to the printing mechanism through manual operation. The latter is normally realized by compressing two hand levers, which are formed as a handle, with one hand, thereby actuating a mechanism that successively conveys the labels to the printing mechanism and presses the printing patterns of the printing mechanism to the respectively foremost label on the label carrier tape such that the printing patterns print the desired number and/or letter sequence onto the label. The hand-held labelling device moreover has an ink roller holding system that presses the ink roller to the printing pattern when the hand levers are compressed, thereby transferring the ink contained in the ink receiving roller onto the printing patterns. The ink roller holding system has a rocker to the free end of which the ink roller holder is mounted together with the ink roller. When the printing patterns are pressed onto the label, the rocker is forced away from the printing patterns such that the ink roller is rolled over the printing patterns.

The person using the hand-held labelling device must then only transfer the foremost printed label to an object onto which it is to be glued. Towards this end, the hand-held labelling device normally has a pressing means formed as a roller, which is disposed on an end area of the hand-held labelling device facing away form the hand lever. The printed label is also further conveyed to this roller by means of the above-mentioned mechanism such that the label can be easily transferred to an object onto which the label is to be glued.

Most conventional ink rollers and hand-held labelling devices require several work steps for removing and inserting the ink roller to change the ink roller. The parts to be changed often consist of three components, i.e. the ink receiving roller itself, the ink roller holder and the ink roller axis. The free end of the rocker is often difficult to access, which aggravates the changing process. Since the ink of the ink receiving roller slightly stains, a change of the ink roller often entails soiling and dirtying.

It is the underlying purpose of the invention to provide an ink roller for a hand-held labelling device and a hand-held labelling device with an ink roller, which eliminate the disadvantages of prior art, in particular, wherein exchange of the ink roller is facilitated and more convenient for the user.

SUMMARY OF THE INVENTION

This object is achieved by the ink roller and the hand-held labelling device in accordance with the claims. The dependent claims represent preferred embodiments of the invention.

An inventive ink roller for a hand-held labelling device has a jacket-shaped ink receiving roller, produced e.g. from a foamed material, and an ink roller axis produced e.g. from a rigid bending-resistant plastic material or designed as a metal pin. The ink receiving roller is disposed on the ink roller axis in such a fashion that the free ends of the ink roller axis project on both sides past the end faces of the ink receiving roller, i.e. form stub shafts. In accordance with the invention, each free end of the ink roller axis has one gripping disk that is produced e.g. from plastic material and is spaced apart from the ink receiving roller. Each gripping disk therefore forms an end-face termination of the ink roller axis and thereby of the entire ink roller.

The ink roller is designed as one single part that must be exchanged when an ink roller exchange is necessary, enabling easy and quick change. The inventive ink roller can be reliably and cleanly gripped with two fingers by a person exchanging the ink roller by means of the two gripping disks disposed on the outer sides of the ink roller, i.e. on the end faces of the ink receiving roller. The fingers thereby do not contact the ink receiving roller and are therefore not soiled with ink. Due to the separation between the gripping disks and the ink receiving roller, receptacles are formed between the ink receiving roller and the gripping disks, into which rocker arms of an ink roller rocker can engage to enable rotatable bearing of the ink receiving roller in the area of the receptacles.

One ink receiving roller delimiting disk (run-off disk) is advantageously formed on each of the two end faces of the ink receiving roller on the ink roller axis, wherein one receptacle is provided for an ink roller axis holder between each ink receiving roller delimiting disk and the respective gripping disk. Rocker arms of an ink roller rocker, to which the ink roller is mounted such that it can be rotated about its longitudinal axis, can be reliably and easily received. Since the rocker arms do not contact the ink receiving roller in this case, one obtains a particularly smoothly running bearing, i.e. which rotates without friction.

The run-off disks are moreover used to transfer a force for pushing away the ink roller from the printing patterns of a hand-held labelling device when the hand levers of the hand-held labelling device are compressed, such that the ink receiving roller is not or only slightly compressed during pushing away. Each run-off disk may be designed in one piece together with one gripping disk. Each run-off disk directly borders the ink receiving roller and each gripping disk is spaced apart from the respective run-off disk such that one receptacle is provided for one ink roller axis holder between one run-off disk and one gripping disk. This means that the ink roller is rotated on the axial sections between the run-off disks and the gripping disks upon actuation of a hand-held labelling device into which it is inserted. The ink roller axis is delimited with respect to the ink receiving roller via the run-off disks. The ink roller may be designed in such a fashion that the run-off disks and the gripping disks can be removed from the ink roller axis when required for inserting or changing the ink receiving roller.

The diameter of the gripping disks is preferably at least as large as the diameter of the ink receiving roller such that the fingers of a person holding the ink roller by the gripping disks, are completely shielded from the ink receiving roller.

An inventive hand-held labelling device has a label printing mechanism and transport means for manually operable further transport of labels, which are disposed one after the other on a label carrier tape, to the label printing mechanism. An ink roller holding system is also provided. In accordance with the invention, the ink roller holding system has a one-piece ink roller rocker which is disposed to be rotatable about a swing axle, wherein the ink roller rocker forms two rocker arms which project in a radial direction from the swing axle and are preferably connected in the area of the swing axle, e.g. by the swing axle itself, and wherein in the area of the free end of each rocker arm facing away from the swing axle, one respective notch is formed for rotatably bearing the ink roller axis of a preferably inventive ink roller. Each rocker arm thereby engages between one of the griping disks and the ink receiving roller of the ink roller.

The rocker is made in one piece, i.e. is formed as one single component, whereby the ink roller is directly disposed on the rocker, i.e. without an intermediate ink roller holder designed as an additional part. The ink roller can therefore be exchanged in a particularly rapid and simple fashion.

In order to ensure reliable and uniform dying of printing patterns of the label printing mechanism, a spring is provided which is arranged to load the ink roller rocker with a torque about the swing axle in such a fashion that the ink roller, which is disposed in the ink roller rocker, is pressed to the label printing mechanism.

Irregular dying of the printing patterns can additionally be minimized by forming a stiffening strut on the ink roller rocker, which stiffening strut connects the rocker arms of the ink roller rocker.

With particular preference, the notches are formed on the rocker arms for locking the ink roller axis. Additional parts for securing the ink roller on the ink roller rocker are therefore superfluous.

One particularly preferred variant comprises a device housing with an ink roller folding lid, wherein the ink roller rocker is mounted via the swing axle to the ink roller folding lid in such a fashion that, by folding open the ink roller folding lid, the ink roller rocker with ink roller can be folded out of a device housing.

In this fashion, the ink roller is particularly easy to access to be changed. The person changing the ink roller can then hold the ink roller between two fingers during the entire change process.

The gripping disks may thereby have a double function in that they guide the ink roller, which is inserted into the hand-held labelling device, below the label printing mechanism during pivoting into the hand-held labelling device.

The invention is explained in more detail below by means of embodiments with reference to the drawings.

DESCRIPTION OF THE PREFERRED EMBODIMENT

Figure 1:
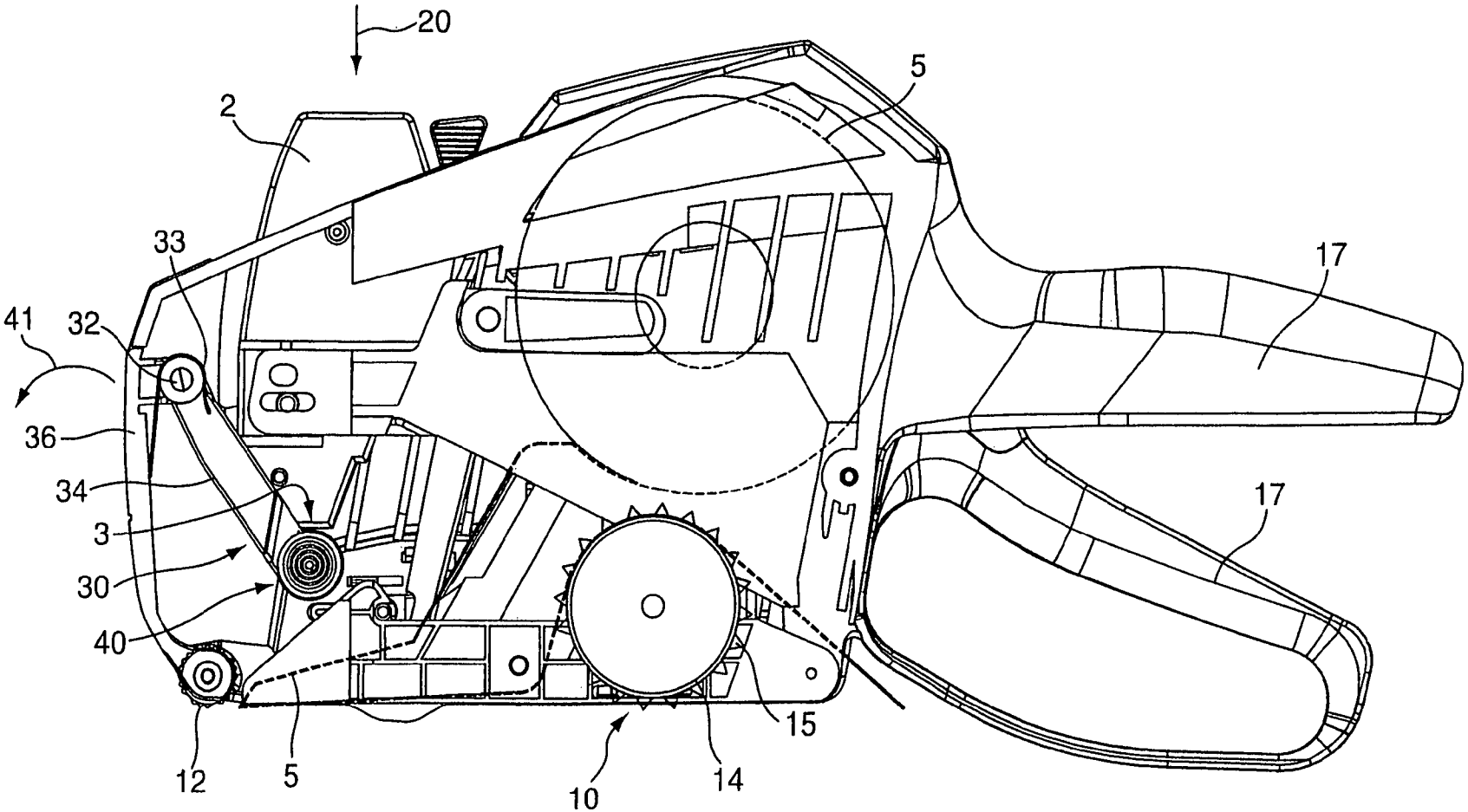
FIG. 1 shows a sectional view of an inventive hand-held labelling device.

The figures of the drawing show the inventive subject matter in a highly schematized fashion and are not to be taken to scale. The individual components of the inventive subject matter are shown in such a fashion that their construction is clearly illustrated.

FIG. 1 shows a sectional view of an inventive hand-held labelling device. The hand-held labelling device has a label printing mechanism 2 with printing patterns 3 that can be preset. A rolled-up label carrier tape 5 with adhesive labels to be printed, which are disposed one after the other, is disposed in a holder, e.g. a chamber within the housing of the hand-held labelling device such that it can be unrolled. The course of the label carrier tape 5 within the hand-held labelling device is indicated in the figure with dashed lines. The individual labels are not illustrated in the drawing.

The labels can be successively further transported to the label printing mechanism 2 by means of manually operable transport means 10, and after printing, be further transported via the printing patterns 3 to the pressing means 12, formed as a roller. The pressing means 12 are used to press the foremost label printed by means of the label printing mechanism 2 to an object onto which the label is to be glued.

The transport means 10 may e.g. be designed in accordance with conventional embodiments of hand-held labelling devices as described in prior art. In the example of the figure, the transport means 10 have a roller-like wheel 14 with teeth 15 (carriers) formed on its roller surface. These teeth 15 engage in the label carrier tape 5. The wheel 14 is turned through a defined angle during actuation of the transport means 10, thereby further unrolling the label carrier tape 5 by one label.

Towards this end, the transport means 10 have two hand levers 17 which are designed as a handle, are spring-loaded with respect to each other by a spring (not shown), and actuate a mechanism by compressing them with one hand, which mechanism successively conveys the labels to the label printing mechanism 2 by unrolling the label carrier tape 5, and presses the printing patterns 3 of the label printing mechanism 2 to the respectively first label on the label carrier tape 5 in such a fashion that the printing patterns 3 print the desired preset symbol sequence, e.g. a number and/or letter sequence, on the label. Upon pressing, the label printing mechanism 2 is pressed to the label in the direction of movement shown by arrow 20.

An ink roller holding system 30 is provided between the label printing mechanism 2 and the area of the label carrier tape 5 on which the respectively foremost label is located. The ink roller holding system 30 has a one-piece ink roller rocker 34 that is disposed to be pivotable about a swing axle 32 and is mounted to an ink roller folding lid 36 of the device housing of the hand-held labelling device via the swing axle 32 such that by folding open the ink roller folding lid 36, the ink roller rocker 34 with the inventive ink roller 40 contained therein can be folded out of a device housing by folding open the ink roller folding lid 36. The latter is symbolically shown by a curved arrow 41 in FIG. 1.

A spring 33 is provided in the area of the swing axle 32, which loads the ink roller rocker 34 with a torque about the swing axle 32 in such a fashion that the ink roller 40 disposed in the ink roller rocker 34 is pressed to the label printing mechanism 2. When the printing patterns 3 are pressed onto the label to be printed, the ink roller rocker 34 is forced away from the printing patterns 3 such that the ink roller 40 is rolled over the printing patterns 3.

Figure 2:
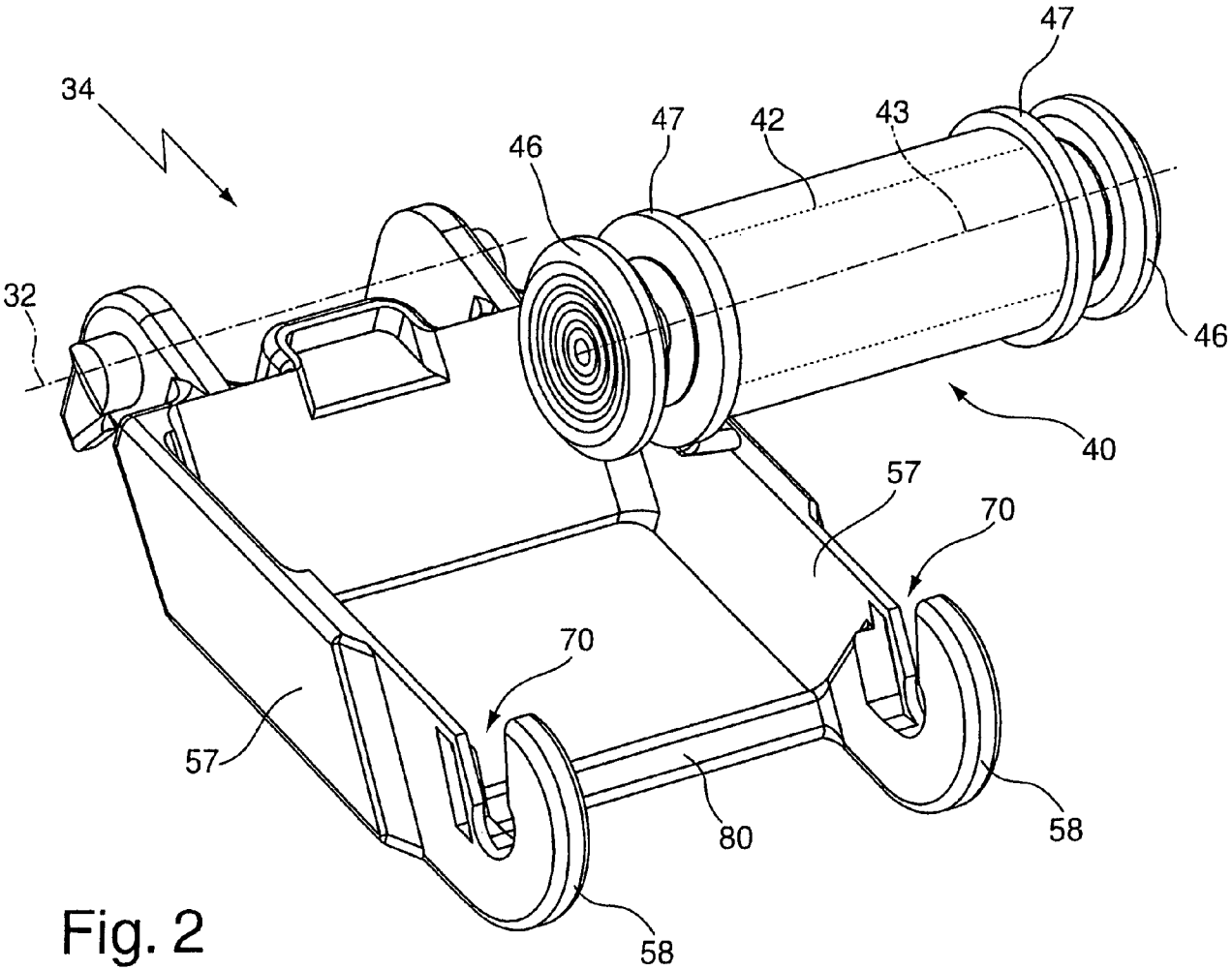
FIG. 2 shows a perspective view of the ink roller holding system of an inventive hand-held labelling device with an inventive ink roller.

FIG. 2 shows a perspective view of the ink roller holding system of the inventive hand-held labelling device in accordance with FIG. 1 with an inventive ink roller 40.

The ink roller 40 has a jacket-shaped ink receiving roller 42 and an ink roller axis 43. The ink receiving roller 42, which is produced from a material that absorbs ink well, e.g. foamed material, is pushed over the ink roller axis 43 like a jacket. The shape of the ink roller axis 43 within the area filled by the ink receiving roller 42 is shown with dotted lines. The ink for printing the labels is stored in the pores in the ink receiving roller 42. The ink receiving roller 42 is disposed on the ink roller axis 43 such that the free ends of the ink roller axis 43 project on both sides past the end faces of the ink receiving roller 42. The projecting free ends form bearings for rotatably bearing the ink roller axis 43 in the ink roller rocker 34 of the ink roller holding system.

Each free end of the ink roller axis 43 has one gripping disk 46, which is e.g. designed in one piece with the ink roller axis 43 and is formed on each free end of the ink roller axis 43 at a separation from the ink receiving roller 42. The inventive ink roller 40 may also be designed in several parts. Each gripping disk 46 and respective ink receiving roller delimiting disk 47 may e.g. be designed as one single plastic part, wherein each respective plastic part can be disposed onto a free end of the ink receiving roller 42. The end faces of the gripping disks 46 have a corrugated surface structure such that the gripping disks 46 can be gripped without slipping.

One ink receiving roller delimiting disk 47 is formed on each of the two end faces of the ink receiving roller 42 on the ink roller axis 43. This provides one receptacle for each ink roller axis holder between each ink receiving roller delimiting disk 47 and the respective gripping disk 46. Each bearing for bearing the ink roller axis 43 is therefore located between one of the ink receiving roller delimiting disks 47 and the respective one of the gripping disks 46. The diameter of the gripping disks 46 is as large as the diameter of the ink receiving roller 42. The axial length of the ink roller 40 is approximately three centimeters and the diameter of the ink roller 40 and thereby the diameter of the gripping disks 46 is approximately one centimeter.

The ink roller rocker 34 forms two rocker arms 57 which are connected in the area of the swing axle 32 and radially project from the swing axle 32, which is illustrated in the figure with dashed lines for clarification. One of the notches 70 is formed in the area of each free end 58 of each rocker arm 57 facing away from the swing axle, for rotatably bearing the ink roller axis 43 of the ink roller 40. The ink roller 40 can be locked in the notches 70 in such a fashion that one of the rocker arms 57 engages between one of the gripping disks 46 having a corrugated end face and the ink receiving roller 42 of the ink roller 40.

In the figure, the ink roller 40 is shown being removed from the notches 70 of the rocker arms 57.

The figure thereby clearly shows that the lower ends of the notches 70 are rounded such that the ink roller 40 can rotate safely and preferably without friction in the notches 70 about its longitudinal axis, i.e. its ink roller axis 43. The ink roller axis 43 is connected to the ink receiving roller 42 for secure mutual rotation therewith.

The ink roller 40 is thereby disposed between the rocker arms 57 parallel with respect to the swing axle 32. Each free end of each rocker arm 58 engages between one of the gripping disks 46 and the ink receiving roller 42 of the ink roller 40 or the subsequent ink receiving roller delimiting disks 47 when the ink roller 40 is locked. A stiffening strut 80, which connects the rocker arms 57 of the ink roller rocker 34, is formed on the ink roller rocker 34 for stiffening the ink roller rocker 34.

Figure 3:
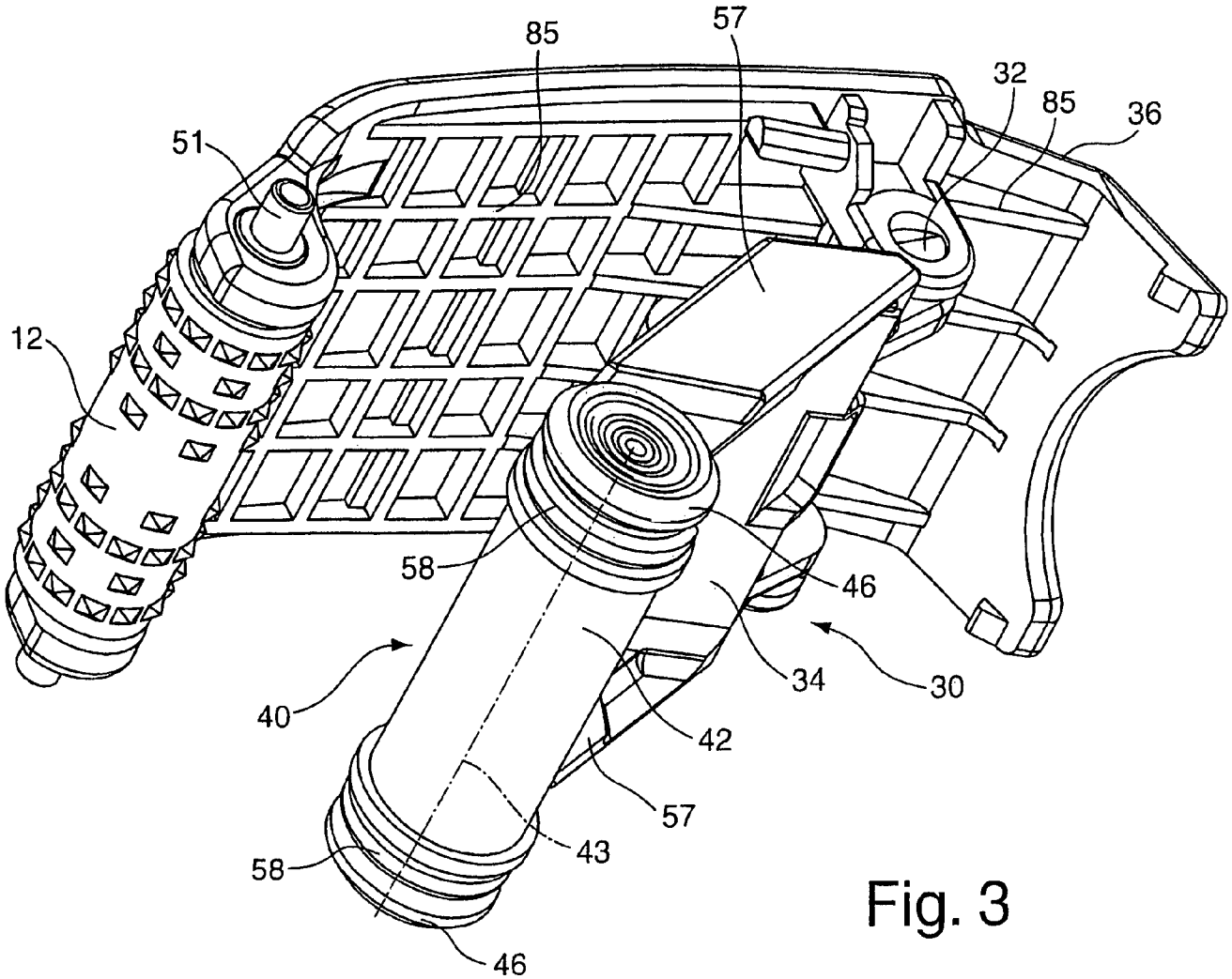
FIG. 3 shows a perspective view of an ink roller folding lid with an ink roller holding system in accordance with FIG. 2 of an inventive hand-held labelling device.

FIG. 3 shows a perspective view of the ink roller folding lid 36 with the ink roller holding system 30 of the inventive hand-held labelling device in accordance with FIG. 1.

The ink roller holding system 30 forms, together with the ink roller folding lid 36 and the ink roller 40, an ink roller changing system. The ink roller rocker 34 is mounted via its swing axle 32 to the ink roller folding lid 36 such that it can be rotated about the swing axle 32.

In the embodiment shown in the figure, a roller is rotatably mounted to the ink roller folding lid 36. This roller (pressure roller) is used as pressing means 12 for pressing the foremost label, printed by means of the label printing mechanism, to an object to be provided with the label. The axis of rotation 51 of the pressure roller is also used as a folding-open axis of the ink roller folding lid 36 in the illustrated embodiment. The ink roller folding lid 36 has stiffening ribs 85 in order to stiffen it.

The ink roller rocker 34 forms two rocker arms 57, which are connected in the area of the swing axle 32 and project in a radial direction from the swing axle 32. One notch covered by the ink roller 40 in the figure is formed in the area of each free end 58 of each rocker arm 57 facing away from the swing axle for rotatably bearing its ink roller axis 43 shown with dashed lines of the ink roller 40. The ink roller 40 is locked in the notches such that one of the rocker arms 57 engages between one gripping disk 46 and the ink receiving roller 42 of the ink roller 40.

The invention proposes an ink roller 40 for a hand-held labelling device with a jacket-shaped ink receiving roller 42 and an ink roller axis 43, wherein the ink receiving roller 42 is disposed on the ink roller axis 43 in such a fashion that the free ends of the ink roller axis 43 project on both sides past the end faces of the ink receiving roller 42, and a hand-held labelling device having such an ink roller 40.

Each free end of the ink roller axis 43 thereby has one gripping disk 46 that is spaced apart from the ink receiving roller 42.

It is clear that the invention includes all embodiments of ink rollers for hand-held labelling devices, comprising free ends of stub shafts beyond the run-off disks, the stub shafts being delimited at their free ends by gripping disks.

The invention is not limited to the above-mentioned embodiments. A number of variants are rather feasible which utilize the features of the invention although they may have a completely different design.

I claim:

1. A hand-held labelling device for processing labels sequentially disposed on a label carrier tape, the device comprising:

a housing;

an ink roller folding lid mounted to said housing via a folding lid pivot axis;

a label printing mechanism disposed in said housing;

transport means, disposed in said housing, for manually operable further transport of the labels to said label printing mechanism;

a jacket-shaped ink receiving roller having a first end face and a second end face;

an ink roller axis having a first free end and a second free end, wherein said ink receiving roller is disposed on said ink roller axis in such a fashion that said first free end of said ink roller axis projects past said first end face of said ink receiving roller and said second free end of said ink roller axis projects past said second end face of said ink receiving roller;

a first gripping disk disposed on said first free end of said ink roller axis at a separation from said first end face of said ink receiving roller;

a second gripping disk disposed on said second free end of said ink roller axis at a separation from said second end face of said ink receiving roller, wherein diameters of said first and said second gripping disks are at least as large as a diameter of said ink receiving roller; and an ink roller holding system, said ink roller holding system having a one-piece ink roller rocker which is disposed to be rotatable about a swing axle, said swing axle being mounted to said ink roller folding lid, said ink roller rocker having a first and a second rocker arm, each of which projects in a radial direction from said swing axle, wherein said first rocker arm has a first free end facing away from said swing axle and a second free end facing away from said swing axle, said first free end defining a first notch and said second free end defining a second notch, said first and said second notches cooperating with and rotatably bearing said ink roller axis, said first rocker arm thereby engaging between said first gripping disk and said first end face of said ink receiving roller and said second rocker arm thereby engaging between said second gripping disk and said second end face of said ink receiving roller, wherein said housing, said folding lid pivot axis, said ink roller folding lid, said swing axle, said ink roller rocker, said ink roller axis and said ink receiving roller are disposed, structured and dimensioned in such a manner that, when said ink roller folding lid is pivoted away from said housing, said ink receiving roller pivots out of said housing with said label printing mechanism and said transport means thereby remaining stationary and disposed within said housing.

2. The hand-held labelling device of claim 1, wherein said first end face has a first delimiting disk and said second end face has a second delimiting disk, wherein a first receptacle for an ink roller axis holder is formed between said first delimiting disk and said first gripping disk and a second receptacle for an ink roller axis holder is formed between said second delimiting disk and second gripping disk.

3. The hand-held labelling device of claim 1, wherein said first and said second rocker arms are connected in an area of said swing axle.

4. The hand-held labelling device of claim 1, further comprising a spring which is disposed and structured to load said ink roller rocker with a torque about said swing axle such that the ink receiving roller is pressed toward said label printing mechanism.

5. The hand-held labelling device of claim 1, wherein a stiffening strut which connects said first and said second rocker arms of said ink roller rocker is formed on said ink roller rocker.

6. The hand-held labelling device of claim 1, wherein said first and said second notches are formed to lock said ink roller axis.

* * * * *